US007854625B1

(12) United States Patent
Yuan et al.

(10) Patent No.: US 7,854,625 B1
(45) Date of Patent: Dec. 21, 2010

(54) CONNECTOR FOR FLEXIBLE PRINTED CIRCUIT BOARD

(75) Inventors: Sheng-Tsung Yuan, Taipei (TW); Sheng-Nan Yu, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/815,402

(22) Filed: Jun. 15, 2010

(51) Int. Cl.
*H01R 12/24* (2006.01)

(52) U.S. Cl. ..... 439/495; 439/260

(58) Field of Classification Search ..... 439/260, 439/329, 495
See application file for complete search history.

(56) References Cited

U.S. PATENT DOCUMENTS 4,944,690 A * 7/1990 Imai ..... 439/492
6,352,442 B1 * 3/2002 Kudo ..... 439/260
7,455,547 B2 * 11/2008 Hemmi et al. ..... 439/495
7,789,698 B2 * 9/2010 Hashimoto et al. ..... 439/495
2009/0163067 A1 * 6/2009 Niitsu ..... 439/329
2009/0298319 A1 * 12/2009 Takahashi et al. ..... 439/329
2010/0029119 A1 * 2/2010 Taketomi et al. ..... 439/329

* cited by examiner

*Primary Examiner*—Edwin A. Leon
*Assistant Examiner*—Larisa Tsukerman

(57) ABSTRACT

A connector includes an insulating housing defining a mouth in a front thereof which is surrounded by a bottom wall, two sidewalls and a rear wall, a plurality of terminals disposed in the insulating housing, and an actuator pivotally mounted to the insulating housing for pivotal movement between an open position and a closed position. Two insides of the sidewalls define two receiving cavities in fronts thereof facing to each other and communicating with the mouth. Two opposite side edges of the actuator oppositely protrude to form a pair of pivoting portions at front ends thereof pivoted in the corresponding receiving cavities and against rear sides of the receiving cavities when the actuator is closed. A rear end of the base board protrudes downward to form a locking ridge extending transversely to be restrained behind the rear wall and the connecting props.

5 Claims, 6 Drawing Sheets

CONNECTOR FOR FLEXIBLE PRINTED CIRCUIT BOARD

BACKGROUND OF THE INVENTION

1. Field of the Invention

The present invention generally relates to an electrical connector, and more particularly to an electrical connector for a flexible printed circuit (FPC hereinafter for simplification) board.

2. The Related Art

A traditional FPC connector includes an insulating housing, a plurality of terminals disposed in the insulating housing and an actuator. The actuator is pivotally mounted to the insulating housing and defines two pivoting portions pivoted in two opposite sides of the insulating housing so that the actuator can be opened or closed freely. After inserting an FPC board into the FPC connector, the actuator can rotate from an open position to a closed position. However, for a distance always exists between the pivoting portions of the actuator and the insulating housing, while at the closed position, the actuator is apt to move at random under shaking to cause that the FPC board and the terminals electrically contact each other unsteadily. Moreover, the FPC board is held between the insulating housing and the actuator without any fixtures, so the FPC board may slide out of the FPC connector when the FPC connector is under shaking. As a result, the electrical connection between the FPC board and the terminals is not steady.

SUMMARY OF THE INVENTION

An object of the present invention is to provide a connector adapted for receiving a longitudinally inserted flexible printed circuit board therein. The connector includes an insulating housing defining a mouth in a front thereof which is surrounded by a bottom wall, two sidewalls and a rear wall for receiving the flexible printed circuit board therein, a plurality of terminals disposed in the insulating housing in a transverse row, and an actuator pivotally mounted to the insulating housing for pivotal movement between an open position allowing the flexible printed circuit board to be inserted into the mouth and a closed position to which the actuator rotates rearward. Two insides of the sidewalls define two receiving cavities in fronts thereof facing to each other and communicating with the mouth. Each of the terminals has a lying-U shaped base frame which has a lower arm disposed in the bottom wall, an upper arm stretching into the mouth, and a connecting prop connecting two rear ends of the upper arm and the lower arm and disposed in the rear wall. The flexible printed circuit board is inserted between the lower arms and the upper arms for electrically connecting the terminals. The actuator has a base board of which a front end defines a plurality of locating slots arranged in a transverse row. A propping beam is traversed in front of the locating slots. Two ends of the propping beam oppositely protrude to form a pair of pivoting portions pivoted in the corresponding receiving cavities of the insulating housing and against rear sides of the receiving cavities when the actuator is closed. Front ends of the upper arms of the terminals pass through the corresponding locating slots to straddle the propping beam. A middle of the base board covers on the rear wall when the actuator is closed. A rear end of the base board protrudes downward to form a locking ridge extending transversely to be restrained behind the rear wall and the connecting props of the terminals.

As described above, when the actuator is at a closed position, the restraining block abuts rearward against the rear sides of the corresponding receiving cavities and the locking ridge is restrained behind the rear wall and the connecting props of the terminals to prevent the actuator from moving at random so that the actuator can be firmly closed to ensure an steady contact between the terminals and the FPC board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
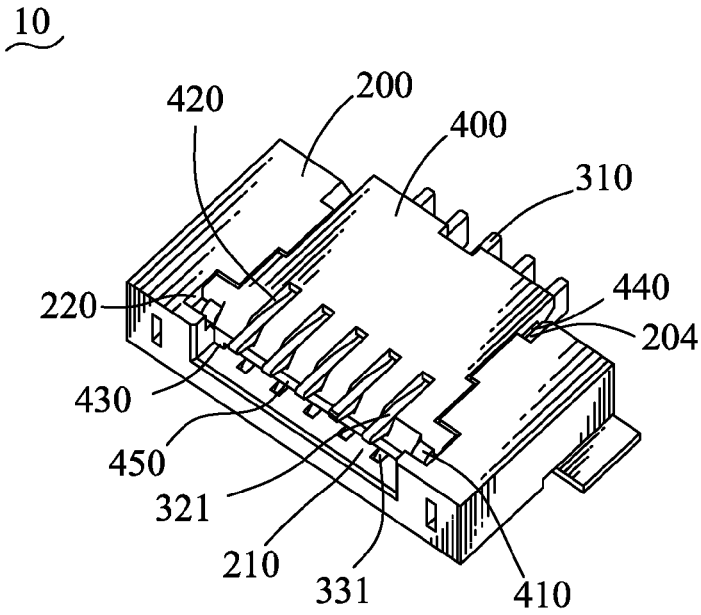
FIG. 1 is an assembled perspective view of an FPC connector in accordance with the present invention.
Figure 2:
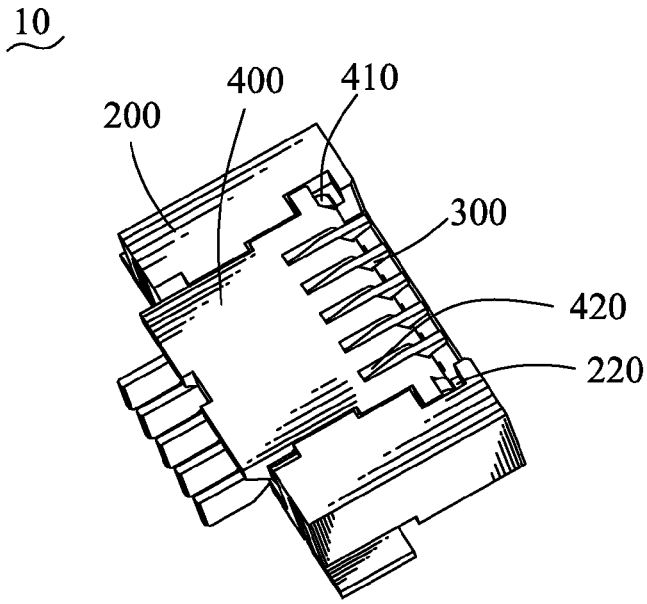
FIG. 2 is an assembled perspective view of the FPC connector of FIG. 1 viewed from another angle.
Figure 3:
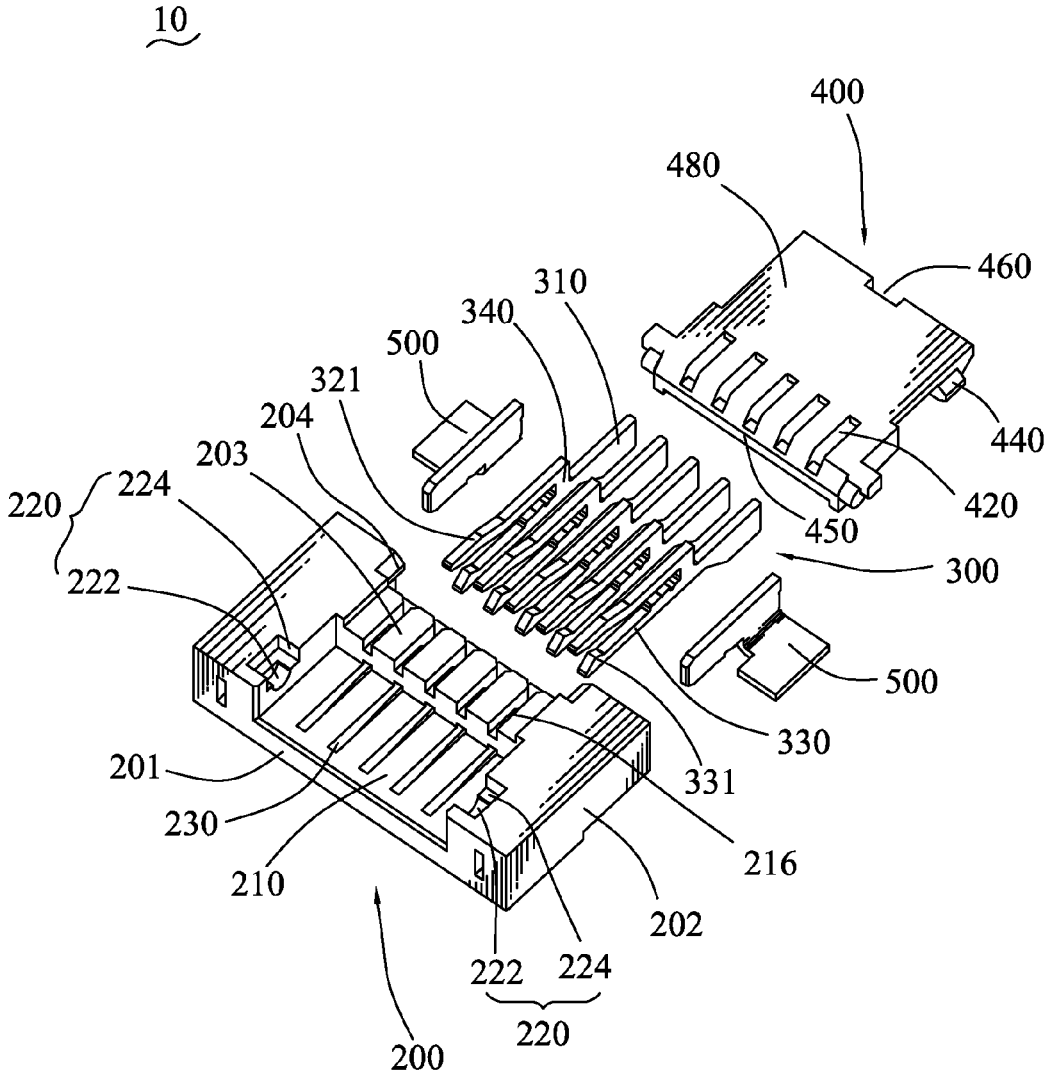
FIG. 3 is an exploded perspective view of the FPC connector of FIG. 1.

With reference to FIG. 1 and FIG. 3, an FPC connector 10 according to the present invention includes an insulating housing 200, a plurality of terminals 300, an actuator 400 and a pair of auxiliary members 500.

Figure 4:
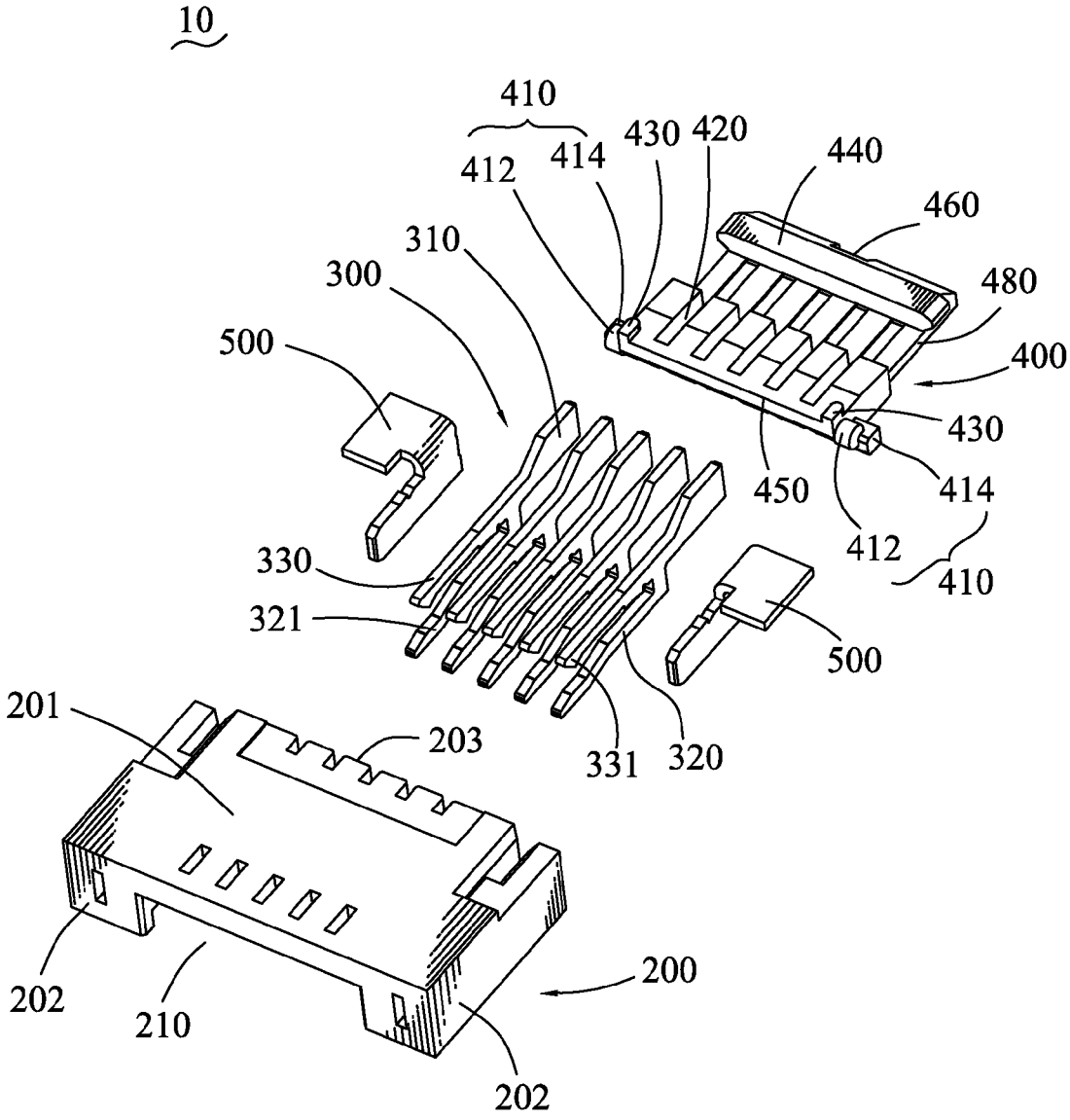
FIG. 4 is an exploded perspective view of the FPC connector of FIG. 1 viewed from another angle.
Figure 5:
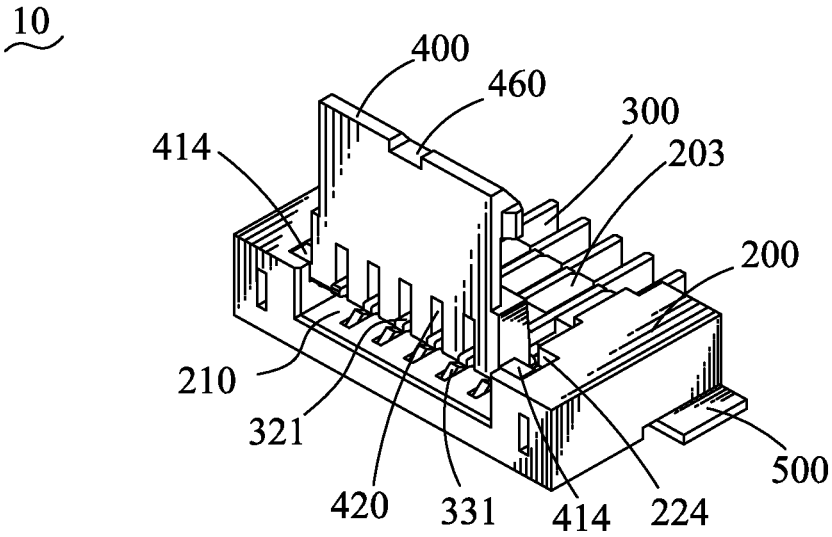
FIG. 5 is a perspective view of the FPC connector of FIG. 1, wherein an actuator of the FPC connector is opened.
Figure 6:
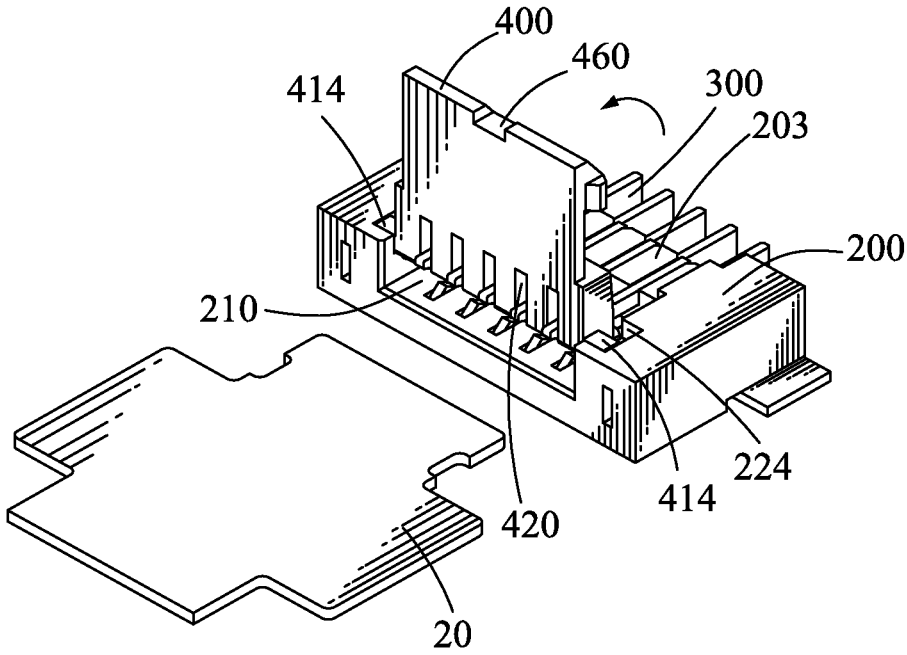
FIGS. 6-8 are perspective views showing that the FPC connector is connected with an FPC board.
Figure 7:
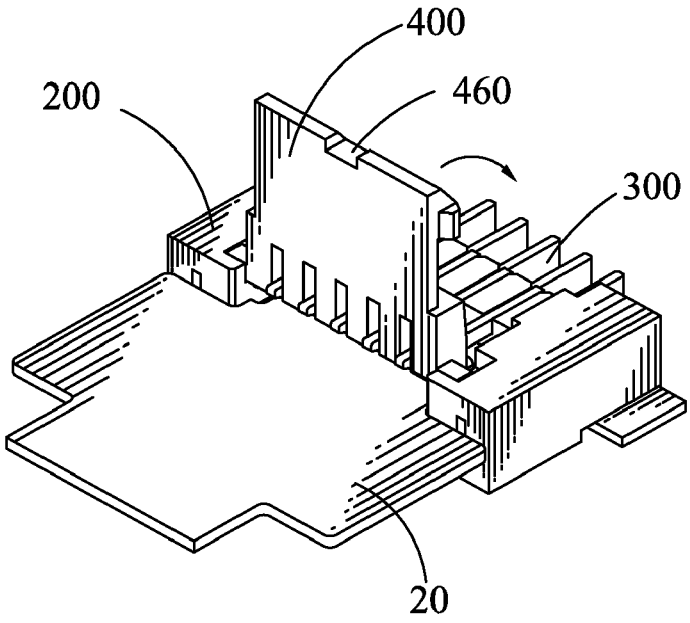
Figure 8:
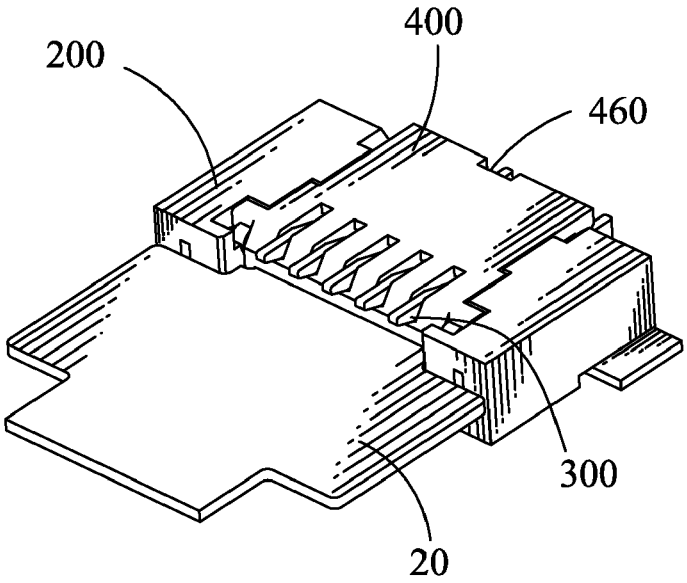

Referring to FIG. 3 and FIG. 4, the insulating housing 200 is of rectangular shape and has a bottom wall 201, two sidewalls 202 and a rear wall 203 lower than the sidewalls 202. A mouth 210 is formed in the front of the insulating housing 200 and among the sidewalls 202, the rear wall 203 and the bottom wall 201. A top face of the bottom wall 201 defines a plurality of lower grooves 230 arranged at regular intervals along a transverse direction thereof, and extending from front to rear to pass through the rear wall 203. A top face of the rear wall 203 defines a plurality of upper grooves 216 corresponding to the lower grooves 230 respectively. Two insides of the sidewalls 202 define two receiving cavities 220 in the front thereof, facing to each other and communicating with the mouth 210. The receiving cavity 220 includes a rectangular receiving fillister 224 open at a top face and the inside of the side wall 202, and a pivoting cavity 222 of semicircular shape connected with a portion of a bottom of the receiving fillister 224 and communicating with the mouth 210. The rear wall 203 is apart from two rear ends of the sidewalls 202. The two rear ends of the sidewalls 202 protrude towards each other to form a pair of locking projections 204 at the tops thereof.

Referring to FIG. 3 and FIG. 4 again, each of the terminals 300 has a base frame 315 of substantial lying-U shape with an upper arm 320, a lower arm 330, and a connecting prop 340 connecting two rear ends of the upper arm 320 and the lower arm 330. A free end of the lower arm 330 protrudes towards the upper arm 320 to form a contact portion 331. A front end of the upper arm 320 is defined as a bearing portion 321 slightly arched oppositely to the lower arm 330. A junction of the connecting prop 340 and the lower arm 330 extends towards an opposite direction to the lower arm 330 to form a soldering foot 310.

Referring to FIGS. 3-4 again, the actuator 400 has a substantially rectangular base board 480 disposed levelly. A front end of the base board 480 defines a plurality of locating slots 420 arranged at regular intervals along a transverse direction thereof and corresponding to the upper grooves 216 of the insulating housing 200. Accordingly, a propping beam 450 is traversed in front of the locating slots 420. Two ends of the propping beam 450 oppositely protrude to form a pair of pivoting portions 410 of which each includes a pivoting axle 412 and a substantially square restraining block 414 protruded at a rear top of the pivoting axle 412. The two ends of the propping beam 410 protrude downward to form a resisting portion 430 respectively. A rear end of the base board 480 protrudes downward to form a locking ridge 440 extending transversely beyond two opposite side edges of the base board 480. A gap 460 is opened in a middle of a rear edge of the base board 480.

Figure 9:
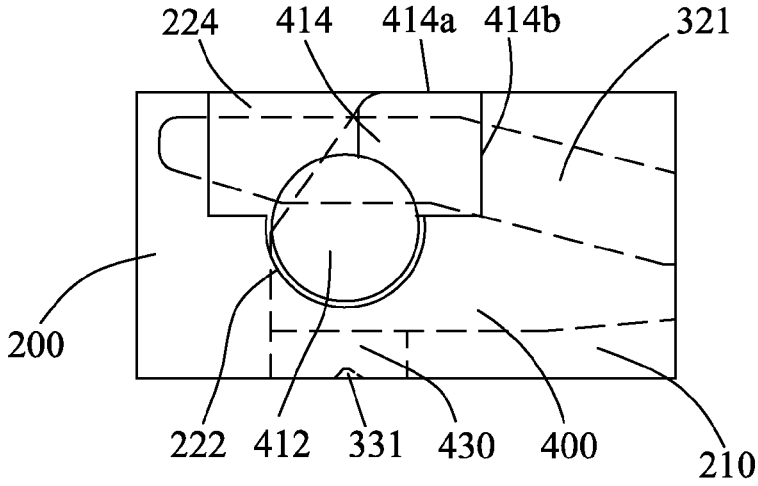
FIGS. 9-10 are sectional views of the FPC connector of FIG. 1, showing that the actuator is at an open position and a closed position respectively.
Figure 10:
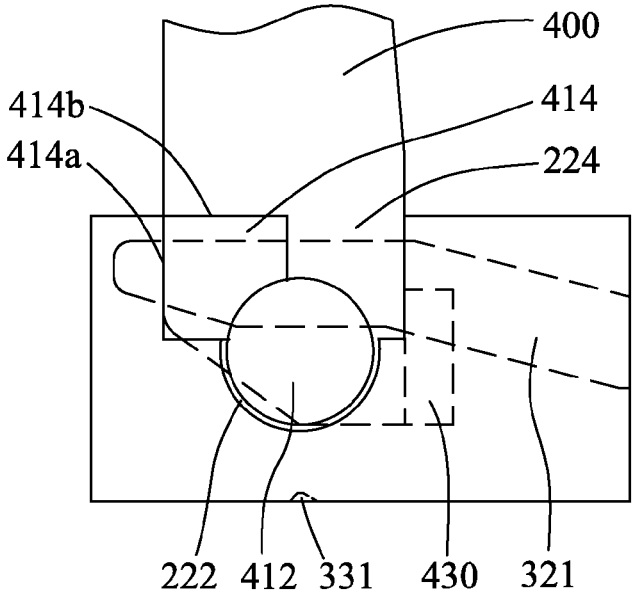

Referring to FIGS. 1-5, in assembly, the actuator 400 is pivotally mounted to the insulating housing 200 for pivotal movement between an open position allowing an FPC board 20 to be inserted into the mouth 210 and a closed position to which the actuator 400 rotates rearward. The pivoting axles 412 of the actuator 400 are pivoted in the corresponding pivoting cavities 222, and the restraining blocks 414 are received in the corresponding receiving fillisters 224, wherein a rear surface 414*b* of the restraining block 414 abuts against a rear side of the receiving fillister 224 when the actuator 400 is fully closed (shown in FIG. 9), and a top surface 414*a* of the restraining block 414 abuts against a front side of the receiving fillister 224 when the actuator 400 is fully opened (shown in FIG. 10). The terminals 300 are respectively assembled in the insulating housing 200. The connecting prop 340 is disposed in a rear of the rear wall 203. The lower arm 330 is received in the corresponding lower groove 230 and the contact portion 331 projects into the mouth 210. The upper arm 320 is mounted in the corresponding upper groove 216 and further stretches into the mouth 210. The bearing portion 321 passes through the corresponding locating slot 420 of the actuator 400 to straddle the propping beam 410 so as to steadily pivoting the actuator 400 to the insulating housing 200. The soldering foots 310 of the terminals 300 project behind the rear wall 13 for being soldered to a circuit board (not shown). The auxiliary members 500 are respectively mounted in the sidewalls 202 of the insulating housing 200 to be soldered with the circuit board.

Referring to FIGS. 6-10, in use, the actuator 400 is opened forward by hooking the gap 460 upward until the top surface 414*a* of the restraining block 414 is against the front side of the receiving fillister 224. At this time, the actuator 400 is substantially perpendicular to the insulating housing 200. The FPC board 20 is inserted rearward into the mouth 210 of the insulating housing 200, and clipped between the upper arms 320 and the lower arms 330 of the terminals 300 to electrically contact the contact portions 331. Then the actuator 400 is closed rearward by hooking the gap 460 downward. When the actuator 400 is fully covered on the mouth 210 and the rear wall 203 of the insulating housing 200, the rear surface 414*b* of the restraining block 414 is against the rear side of the receiving fillister 224, the locking ridge 440 is restrained behind the rear wall 203 and the connecting props 340 of the terminals 300 with two opposite ends thereof being buckled under the corresponding locking projections 204, so that ensure the actuator 400 closed firmly. Moreover, the resisting portions 430 presses the FPC board 20 downward so that further makes the contact portions 331 tightly contact the FPC board 20. So a steadily electrical connection can be achieved between the FPC connector 10 and the FPC board 20.

As described above, when the actuator 400 is at a closed position, the restraining block 414 abuts rearward against the rear side of the corresponding receiving fillister 224 and the locking ridge 440 is restrained behind the rear wall 203 to prevent the actuator 400 from moving at random so that the actuator 400 can be firmly closed to ensure an steady contact between the terminals 300 and the FPC board 20. Moreover, the resisting portions 430 further press the FPC board 20 downward so that makes the contact portions 331 tightly contact the FPC board 20. So a steadily electrical connection can be further achieved between the FPC connector 10 and the FPC board 20.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector adapted for receiving a longitudinally inserted flexible printed circuit board therein, comprising:

an insulating housing defining a mouth in a front thereof which is surrounded by a bottom wall, two sidewalls and a rear wall for receiving the flexible printed circuit board therein, two insides of the sidewalls defining two receiving cavities in fronts thereof facing to each other and communicating with the mouth;

a plurality of terminals disposed in the insulating housing in a transverse row, each of the terminals having a lying-U shaped base frame which has a lower arm disposed in the bottom wall, an upper arm stretching into the mouth, and a connecting prop connecting two rear ends of the upper arm and the lower arm and disposed in the rear wall, the flexible printed circuit board being inserted between the lower arms and the upper arms for electrically connecting the terminals; and an actuator pivotally mounted to the insulating housing for pivotal movement between an open position allowing the flexible printed circuit board to be inserted into the mouth and a closed position to which the actuator rotates rearward, the actuator having a base board of which a front end defines a plurality of locating slots arranged in a transverse row, a propping beam being traversed in front of the locating slots, two ends of the propping beam oppositely protruding to form a pair of pivoting portions pivoted in the corresponding receiving cavities of the insulating housing and against rear sides of the receiving cavities when the actuator is closed, front ends of the upper arms of the terminals passing through the corresponding locating slots to straddle the propping beam, a middle of the base board covering on the rear wall when the actuator is closed, a rear end of the base board protruding downward to form a locking ridge extending transversely to be restrained behind the rear wall and the connecting props of the terminals.

2. The connector as claimed in claim 1, wherein the receiving cavity of the insulating housing includes a rectangular receiving fillister and a pivoting cavity of semicircular shape connected with a portion of a bottom of the receiving fillister, the pivoting portion of the actuator includes a pivoting axle and a substantially square restraining block protruded at a rear top of the pivoting axle, the pivoting axle is pivoted in the corresponding pivoting cavity and the restraining block is received in the corresponding receiving fillister, wherein a rear surface of the restraining block abuts against a rear side of the receiving fillister when the actuator is closed, and a top surface of the restraining block abuts against a front side of the receiving fillister when the actuator is opened.

3. The connector as claimed in claim 1, wherein two rear ends of the sidewalls of the insulating housing protrude towards each other to form a pair of locking projections at the tops thereof and behind the rear wall, two opposite ends of the locking ridge of the actuator extends beyond two opposite side edges of the base board to be buckled under the corresponding locking projections when the actuator is closed.

4. The connector as claimed in claim 1, wherein the propping beam of the actuator protrudes downward to form at least one resisting portion pressing the flexible printed circuit board downward to make the terminals tightly contact the FPC board, when the actuator is closed.

5. The connector as claimed in claim 1, wherein a junction of the connecting prop and the lower arm of the terminal extends towards an opposite direction to the lower arm to form a soldering foot projecting behind the rear wall.

* * * * *